US007057530B2

(12) United States Patent
Young

(10) Patent No.: US 7,057,530 B2
(45) Date of Patent: Jun. 6, 2006

(54) WARNING SIGN

(76) Inventor: Ronald Alexander ("Scot") Young, 95 Mushroom Green, Dudley Wood, West Midlands, DY2 OEE (GB)

( * ) Notice: Subject to any disclaimer, the term of this patent is extended or adjusted under 35 U.S.C. 154(b) by 140 days.

(21) Appl. No.: 10/783,176

(22) Filed: Feb. 20, 2004

(65) Prior Publication Data

US 2004/0244670 A1 Dec. 9, 2004

(30) Foreign Application Priority Data

Jun. 7, 2003 (GB) ..... 0313157
Oct. 28, 2003 (GB) ..... 0325102.2

(51) Int. Cl.
*G08G 1/095* (2006.01)

(52) U.S. Cl. ..... 340/908; 340/908; 340/907; 40/610

(58) Field of Classification Search ..... 340/908
See application file for complete search history.

(56) References Cited

U.S. PATENT DOCUMENTS

| | | | | |
|---|---|---|---|---|
| 1,058,881 A | | 4/1913 | Matushak | |
| D60,293 S | | 1/1922 | Meden | |
| 2,957,444 A | | 10/1960 | Boettler | 116/63 |
| 3,099,244 A | | 7/1963 | Knapp | 116/63 |
| 3,451,368 A | | 6/1969 | Keats | 116/63 |
| 3,499,413 A | | 3/1970 | Heard | 116/63 |
| 3,520,235 A | | 7/1970 | Palazzolo et al. | 94/1.5 |
| 3,707,320 A | | 12/1972 | Brynes | 350/97 |
| 3,809,007 A | | 5/1974 | Brown | 116/63 |
| D235,744 S | | 7/1975 | England | D10/109 |
| 4,083,033 A | | 4/1978 | Kulp et al. | 340/114 |
| 4,197,808 A | | 4/1980 | Kinninger | 116/63 |
| 4,253,260 A | | 3/1981 | Maza et al. | 40/584 |
| 4,298,186 A | | 11/1981 | Glass | 256/64 |
| 4,329,800 A | | 5/1982 | Shuman | 40/606 |
| D272,809 S | | 2/1984 | Bent et al. | D10/109 |
| D277,738 S | | 2/1985 | Grammas et al. | D10/104 |
| D277,739 S | | 2/1985 | Grammas et al. | D10/104 |
| 4,516,344 A | | 5/1985 | Seely | 40/602 |
| 4,624,210 A | | 11/1986 | Glass | 116/63 |
| 4,796,369 A | * | 1/1989 | Hamann | 40/606.15 |
| 4,999,937 A | | 3/1991 | Bechtold | 40/610 |
| 5,046,885 A | | 9/1991 | Thurston | 404/10 |
| 5,095,642 A | | 3/1992 | George et al. | 40/606 |
| 5,115,623 A | * | 5/1992 | Ahlberg | 52/646 |
| 5,456,033 A | * | 10/1995 | Sachnoff | 40/661 |
| D389,871 S | | 1/1998 | Young | D10/10 |
| 5,964,053 A | | 10/1999 | Liu | 40/610 |
| 6,131,320 A | | 10/2000 | Eberle et al. | 40/610 |
| 6,338,213 B1 | | 1/2002 | Young et al. | 40/610 |

* cited by examiner

*Primary Examiner*—Jeffery Hofsass
*Assistant Examiner*—Eric Blount
(74) *Attorney, Agent, or Firm*—Young & Thompson

(57) ABSTRACT

A warning sign comprises first and second parts [10, 11] pivotably interconnected at their in use upper ends and pivotable between a first storage position in which the first and second parts are arranged in side-by-side relationship and a second operative position in which the first and second parts are at an angle to one another. Detents [16, 17] are also provided for releasably retaining the first and second parts [10, 11] in the second operative position, and a third part is provided which can be releasably supported by the detent.

16 Claims, 3 Drawing Sheets

WARNING SIGN

This invention relates to a warning sign particularly, but not exclusively, for use on wet floors in public places.

It is known from GB 2354625 to provide a two-part pivotable warning sign having a height-adjustable third part which is supportable by the pivotable two-parts. However, this arrangement requires that the warning sign has extra mouldings to enable support of the third part. This results in more complex tooling and thus increased costs.

The present invention seeks to provide an improved warning sign.

According to a one aspect of the present invention there is provided a warning sign comprising first and second parts pivotably interconnected at their in use upper ends and pivotable between a first storage position in which the first and second parts are arranged in side-by-side relationship and a second operative position in which the first and second parts are at an angle to one another, detent means for releasably retaining the first and second parts in the second operative position, and a third part releasably supportable by the detent means.

Preferred and/or optional features of the first aspect of the invention are set forth in claims 2 to 16, inclusive.

Figure 1:
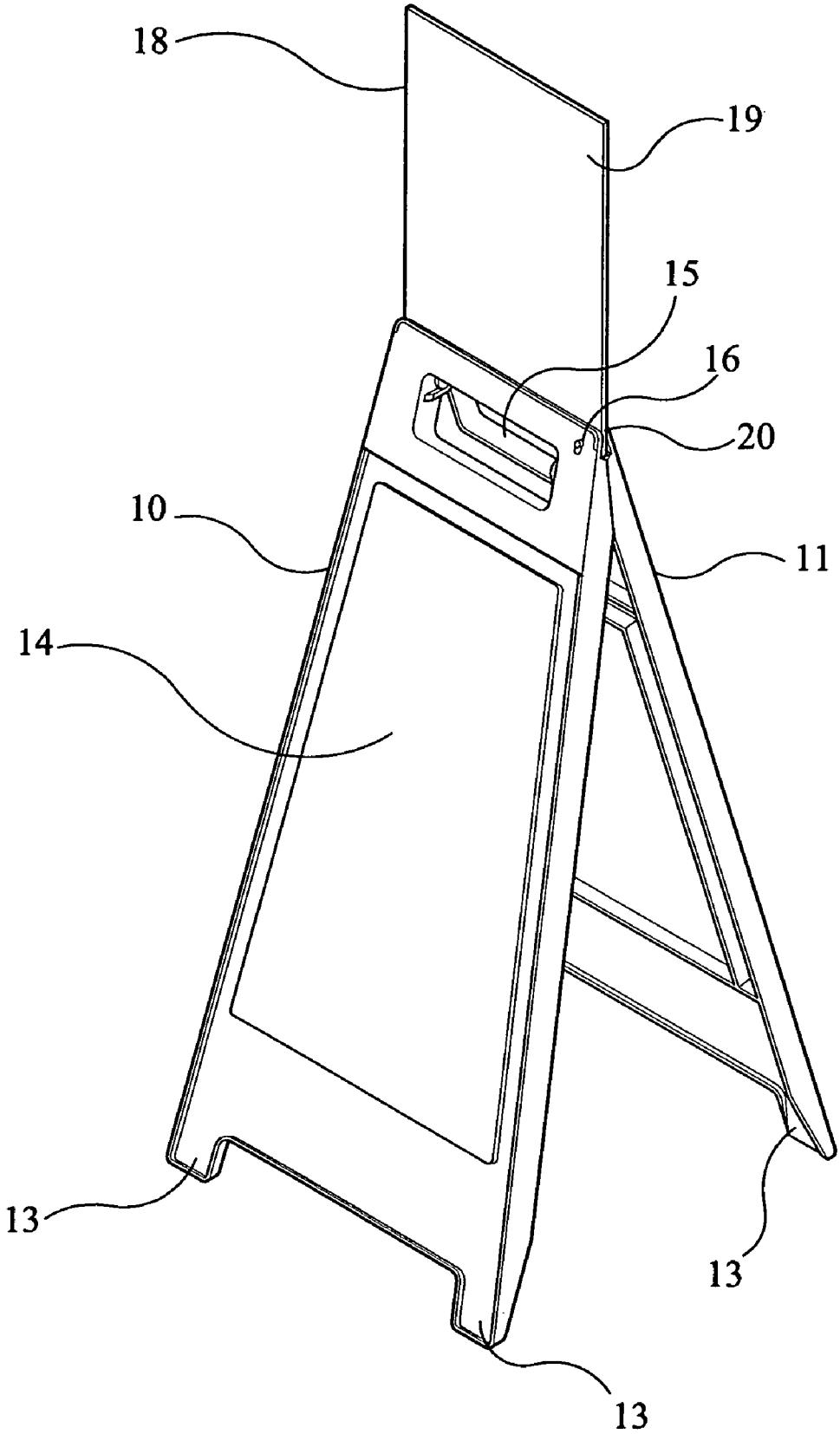
Figure 2:
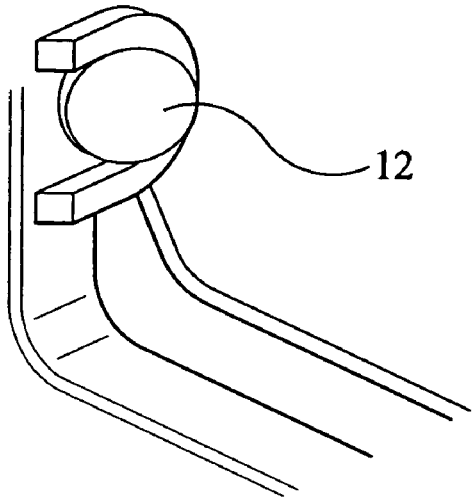
Figure 3:
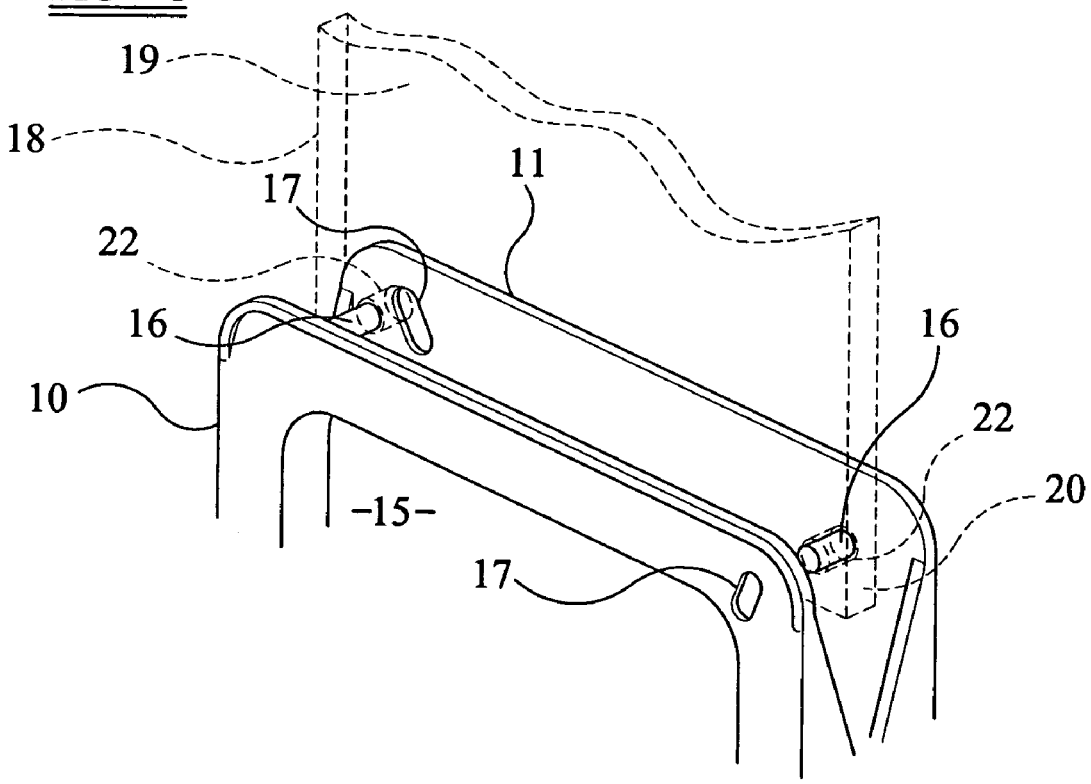
Figure 4:
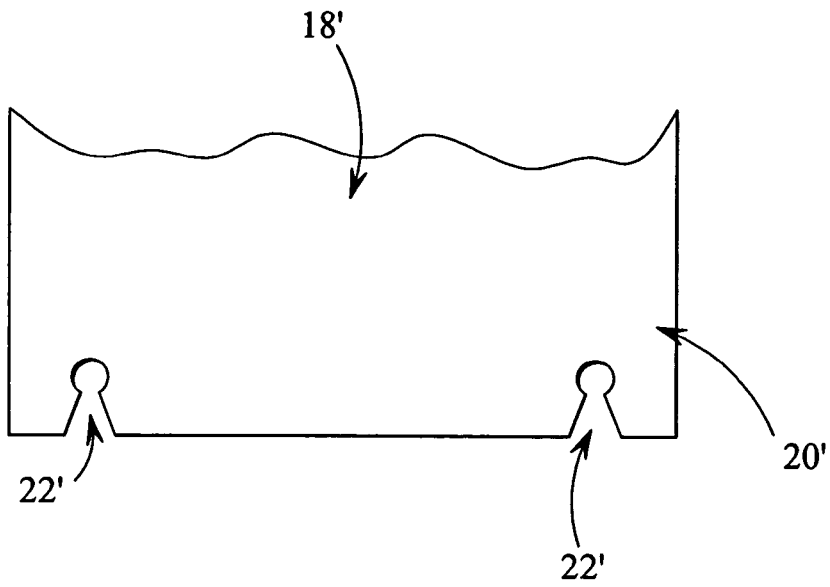
Figure 5:
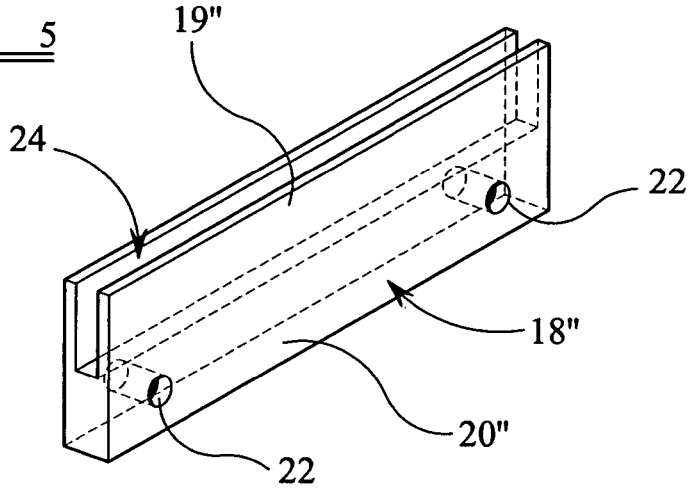
Figure 6:
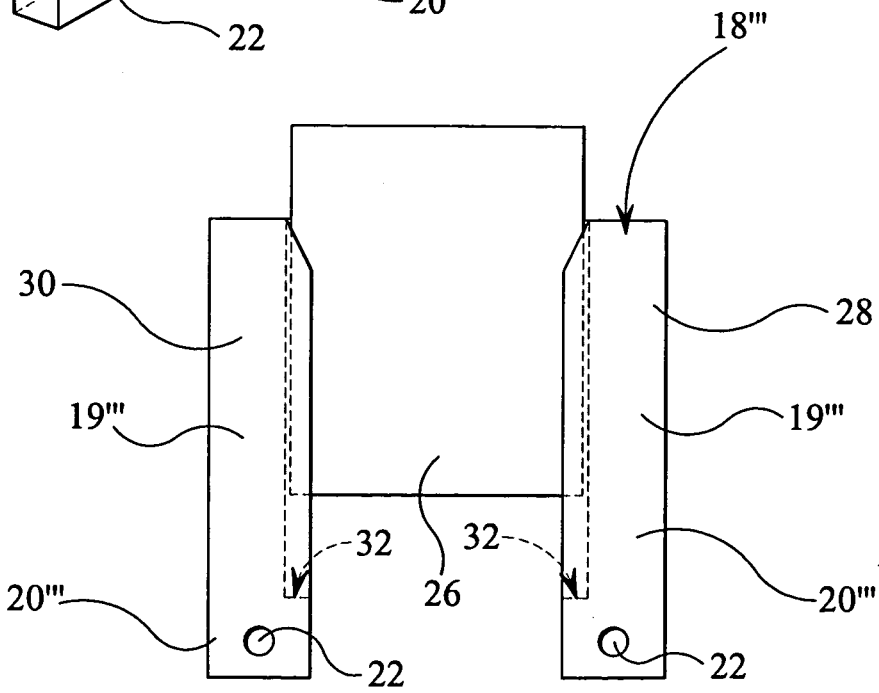

The invention will now be more particularly described by way of example, with reference to the accompanying drawings, in which:

FIG. 1 is a perspective view showing a first embodiment of a warning sign according to the invention, in an operative position, FIG. 2 is a fragmentary perspective view showing a hinge between first and second parts of the warning sign shown in FIG. 1, FIG. 3 is a fragmentary perspective view showing the upper part of the first and second parts of the warning sign in a storage position, and showing the location of a third part in phantom lines, FIG. 4 is a front view of a third part of a second embodiment of the warning sign, in accordance with the invention;

FIG. 5 is a perspective view of a third part of a third embodiment of the warning sign, in accordance with the invention; and FIG. 6 is a perspective view of a third part of a fourth embodiment of the warning sign, in accordance with the invention.

Referring firstly to FIGS. 1 to 3 of the drawings, there is shown therein a warning sign which, for example, can be used to caution the general public in a public place that a potential hazard exists in the vicinity of the sign, such as a wet floor or maintenance work in a restaurant, hospital, railway station and such like. The warning sign comprises first and second parts 10 and 11 pivotably connected together by hinges 12 which are at the in use upper ends of the two parts 10 and 11, but spaced from the upper edges. The hinges 12 enable movement of the first and second parts 10 and 11 between a first storage position in which the two parts lie parallel in a side-by-side relationship (see FIG. 3) and a second operative position in which the two parts are at an angle to one another (see FIG. 1). Each part 10, 11 has feet 13 at its in use lower end so that when the parts 10 and 11 are in the second operative position, the feet will support the sign in an upright position as shown in FIG. 1.

Each part 10 and 11 has a pressed portion 14, for receiving a caution sign, and a hand hole 15. The hinges 12 are integrally formed as part of the side walls defining the hand holes 15. The pressed portions 14 are preferably raised relative to the immediate portions of the parts 10,11 surrounding the pressed portions 14. However, the pressed portions 14 could be recessed. The pressed portion 14 promotes focussing of a viewer's eye on the caution sign.

As best seen in FIG. 3, each part 10, 11 has a projection 16 at the upper end of its inner face spaced from and above the hinges 12. Each projection 16 securely releasably engages an aperture or recess 17 (hereinafter simply referred to as 'aperture 17') in the other part 11, 10 when the two parts 10 and 11 are in the second operative position. The projections 16 are a snap or friction fit in corresponding apertures 17 to allow the two parts to be retained in the second operative position, thereby reducing a tendency for the sign to collapse and/or fall over when impacted.

As shown in FIGS. 1 and 3, the sign also comprises a third part 18. This third part 18 comprises a body portion 19 on which a caution sign can be displayed, in addition to, or as an alternative to, the recess 14. The body portion 19 is a planar or substantially planar element and the caution sign is typically displayed on both major surfaces. However, the body portion 19 could have a polyhedral or cylindrical form allowing the caution sign to be displayed to a greater field of view.

The third part 18 also comprises a support portion 20 adjacent to the bottom of the body portion 19. The support portion 20 includes two openings 22, in the form of through-holes, dimensioned to be able to receive the projections 16. When the first and second parts 10 and 11 are in the first storage position, i.e. when the projections 16 are released from engagement with the apertures 17, the support portion 20 of the third part 18 can be slid between the first and second parts 10 and 11 and the projections 16 can be inserted into and through the openings 22. The length of the projections 16 and the thickness of the support portion 20 are such that the projections 16 extend a sufficient distance beyond the support portion 20 to enable secure and releasable engagement with the apertures 17 when the first and second parts 10 and 11 are in the second operative position.

In a second embodiment of the warning sign, and as shown in FIG. 4, the openings in the support portion 20' of the third part 18' are recesses 22' formed in the bottom edge of the support portion 20'. The upper edges of the first and second parts 10 and 11 may be relied on to aid stabilisation of the third part 18'. Thus, the upper edges of the first and second parts 10, 11 may grip or clamp the third part 18' when in the second operative position.

Preferably, the recesses 22' are keyhole shaped so that the projections 16 of each part 10, 11 are snap-fit receivable in the recesses 22', when the projections 16 are engaged in the apertures or recess 17 of the first and second parts 10, 11 and when the projections 16 are disengaged from the apertures or recesses 17. This inhibits undesired removal of the third part 18', while still allowing simplified engagement and disengagement of the third part 18', when required, when the first and second parts 10, 11 are arranged in the storage and operative positions.

FIG. 5 shows a modified third part 18" for use with a third embodiment of the warning sign. Except where stated or renumbered, the warning sign of the third embodiment corresponds to the warning signs of the first and second embodiments.

In this embodiment, body portion 19" of the third part 18" is formed with a clip. Preferably, the clip is an elongate open-ended U-shaped channel 24. The channel 24 is dimensioned to accept and releasably hold a fourth display part (not shown) as a reasonably tight push-fit along at least its bottom end. The fourth display part has a surface for prominently displaying, or is shaped to depict, a warning or caution sign (not shown).

It is envisaged that the warning sign is provided with a selection of fourth display parts, and that the user simply selects the one with the appropriate warning or caution.

The support portion 20" of the third part 18" is formed with either the through-holes 22 of the first embodiment or the recesses of the second embodiment. In this way, the third part 18" is releasably engageable with and disengageable from the detent means.

This third embodiment not only provides for quick and reliable interchange of warning or caution signs, due to the push-fit engagement of the fourth display part, but also still provides for quick release of the third part from the detent means.

FIG. 6 shows a further modified third part 18''' for use with a fourth embodiment of the warning sign. Again, except where stated or renumbered, the warning sign of the fourth embodiment corresponds to the warning signs of the first and second embodiments.

The third part 18''' comprises two members 28 and 30. Each member 28,30 includes a body portion 19''' and a support portion 20''' . Each body portion 19''' comprises a clip. The clip is preferably an elongate U-shaped channel 32, closed at one end adjacent to the support portion 20''' and open at the other end. Each U-shaped channel 32 is dimensioned to accept and releasably hold a fourth display part 26 as a reasonably tight push-fit or sliding fit along one side and part of the bottom end. As with the third embodiment, the fourth display part 26 has a surface for prominently displaying, or is shaped to depict, a warning or caution sign (not shown).

The support portion 20''' of each member 28,30 is formed with either one through-hole 22 of the first embodiment or one recess of the second embodiment. In this way, the two members 28,30 of the third part 18''' can be releasably engaged with the detent means, as described in the first and second embodiments.

The members 28,30 are supported by the detent means in an upstanding fashion, such that the longitudinal extents of the elongate channels 32 extend in parallel or substantially in parallel with each other. Disengagement from the detent means is as described with regard to the first and second embodiments.

A further modification, not shown, comprises a third part having a body portion in the form of a transparent holder. Preferably, the holder is a transparent sleeve. The support portion of the third part is as previously described. In this case, the fourth display part (which has also been described above) is releasably engaged with the third part by simply being slid into the transparent sleeve.

The warning sign could have only one projection 16 and corresponding aperture 17. This projection could be of non-cylindrical transverse cross section, enabling the third part when supported thereon to remain upright. In addition, or as an alternative, a supporting or seating lip or ledge could be provided on one or each first and second part 10, 11 and on which an edge of the third part abuts when between the first and second parts 10, 11.

Typically, all parts are formed of plastics material with the third part and/or fourth part preferably being resiliently flexible in a direction parallel to the ground on which the warning sign is erected. Due to this flexibility and the secure support of the third part through the holes and/or recesses when in the operative position, stability of the warning sign is increased due to the realisation of a "pendulum" effect that allows reversal of momentum on impact of the third part and/or fourth part, i.e. when a person accidentally knocks the caution sign with a shoulder bag, for example, thus resulting in little or no relative movement of the warning sign subsequent to impact.

The embodiments described above are given by way of example only and other modifications will be apparent to persons skilled in the art without departing from the scope of the invention as defined by the appended claims. For example, the or each recess in the support portion of the third part could be along the side edge or side edges of the third part.

The invention claimed is:

1. A warning sign comprising first and second parts pivotably interconnected at their in use upper ends and pivotable between a first storage position in which the first and second parts are arranged in side-by-side relationship and a second operative position in which the first and second parts are at an angle to one another, detent means for releasably retaining the first and second parts in the second operative position, and a third part releasably supportable by the detent means, and a fourth display part releasably engageable with the third part.

2. A warning sign as claimed in claim 1, wherein the two parts have ground contacting foot portion at their in use lower ends, so that, with said foot portion or portions of one part spaced from said foot portion or portions of the other part, the sign will be self-supporting on the ground.

3. A warning sign as claimed in claim 1, wherein the detent means comprises at least one projection and at least one corresponding aperture or recess, the projection being arranged to fit in the aperture or recess as a snap or friction fit when the first and second parts are in the second operative position.

4. A warning sign as claimed in claim 3, wherein the first and second parts each have one said projection which cooperates with one said corresponding aperture or recess formed in the other part.

5. A warning sign as claimed in claim 3, wherein the third part includes a support portion having one or more openings dimensioned to receive a corresponding said projection therethrough.

6. A warning sign as claimed in claim 5, wherein the or each opening in the third part is a through-hole.

7. A warning sign as claimed in claim 5, wherein the said projection can only be inserted into the corresponding opening of the third part when the first and second parts are in the first storage position.

8. A warning sign as claimed in claim 5, wherein the said projection can only be removed from the corresponding opening of the third part when the detent means is released.

9. A warning sign as claimed in claim 5, wherein the or each opening in the third part is a recess formed in an edge of the third part.

10. A warning sign as claimed in claim 5, wherein at least one said recess is keyhole shaped so as to be snap-fit engageable with the said projection of the detent means.

11. A warning sign as claimed in claim 9, wherein the third part, in use, is engageable with and disengageable from the projection of the detent means, when the first and second parts are in the first storage position and the second operative position.

12. A warning sign as claimed in claim 1, wherein the third part includes an elongated channel in which the bottom end of the fourth display part is receivable.

13. A warning sign as claimed in claim 1, wherein the third part comprises two members, each member including an elongate channel in which a side of the fourth display part is, at least in part, receivable.

14. A warning sign as claimed in claim 1, wherein the third part includes a transparent holder for holding the fourth display part.

15. A warning sign as claimed in claim 14, wherein the transparent holder is a sleeve into which the fourth display part can be slidably inserted.

16. A warning sign comprising first and second parts pivotably interconnected at their in use upper ends and pivotable between a first storage position in which the first and second parts are arranged in side-by-side relationship and a second operative position in which the first and second parts are at an angle to one another, detent means for releasably retaining the first and second parts in the second operative position, a third part releasably supportable by the detent means, and a fourth display part releasably engageable with the third part, wherein the third part includes a transparent holder for holding the fourth display part.

* * * * *